US009691334B2

(12) United States Patent
Kanzaki et al.

(10) Patent No.: US 9,691,334 B2
(45) Date of Patent: Jun. 27, 2017

(54) DEVICE AND METHOD FOR REDUCING POWER CONSUMPTION IN DISPLAY DEVICES

(71) Applicant: International Business Machines Corporation, Armonk, NY (US)

(72) Inventors: Eisuke Kanzaki, Tokyo (JP); Yasutomo D. Nakayama, Tokyo (JP)

(73) Assignee: INTERNATIONAL BUSINESS MACHINES CORPORATION, Armonk, NY (US)

( * ) Notice: Subject to any disclaimer, the term of this patent is extended or adjusted under 35 U.S.C. 154(b) by 323 days.

(21) Appl. No.: 14/065,033

(22) Filed: Oct. 28, 2013

(65) Prior Publication Data

US 2014/0125690 A1 May 8, 2014

(30) Foreign Application Priority Data

Nov. 7, 2012 (JP) ..... 2012-245756

(51) Int. Cl.
*G09G 5/02* (2006.01)
*G09G 3/36* (2006.01)
*G09G 5/10* (2006.01)

(52) U.S. Cl.
CPC ..... *G09G 3/36* (2013.01); *G09G 5/10* (2013.01); *G09G 5/02* (2013.01);
(Continued)

(58) Field of Classification Search
CPC ..... G09G 5/02; G09G 3/36; G09G 2320/066; G09G 2320/0271; G09G 2330/021;
(Continued)

(56) References Cited

U.S. PATENT DOCUMENTS

2002/0050974 A1* 5/2002 Rai ..... G09G 3/3406 345/102
2005/0052446 A1* 3/2005 Plut ..... G06F 1/3218 345/211

(Continued)

FOREIGN PATENT DOCUMENTS

JP 2000112441 A 4/2000
JP 2001142673 A1 5/2001

(Continued)

OTHER PUBLICATIONS

JP 2000-112441A (Machine Translation on Oct. 10, 2015).*
JP 2001-236202A (Machine Translation on Oct. 10, 2015).*

*Primary Examiner* — Gregory J Tryder
*Assistant Examiner* — Michael Le
(74) *Attorney, Agent, or Firm* — Cantor Colburn LLP; Yeen Tham

(57) ABSTRACT

Devices and methods are disclosed that reduce the amount of power consumed by an existing display device irrespective of the display mode. One such method includes recognizing a display mode related to light and dark when no voltage is applied to the display device. The method also includes determining a shift direction for the values of an image based on the recognized display mode so that power consumption is reduced in the display device. The method further includes determining a shift amount for the values of the image in accordance with a predetermined process, and converting the values of the image to be converted in the determined shift direction in accordance with the determined shift amount.

6 Claims, 8 Drawing Sheets

(52) U.S. Cl.
CPC ..... *G09G 2320/0271* (2013.01); *G09G 2320/0606* (2013.01); *G09G 2320/066* (2013.01); *G09G 2320/0666* (2013.01); *G09G 2330/021* (2013.01); *G09G 2360/16* (2013.01); *G09G 2370/027* (2013.01); *G09G 2370/042* (2013.01)

(58) Field of Classification Search
CPC ..... G09G 2320/0666; G09G 2360/16; G09G 2370/027; G09G 5/10; G09G 2320/0606
USPC ..... 345/581, 600
See application file for complete search history.

(56) References Cited

U.S. PATENT DOCUMENTS

| | | | | |
|---|---|---|---|---|
| 2006/0020906 | A1* | 1/2006 | Plut | G06F 1/3218 715/867 |
| 2007/0002035 | A1* | 1/2007 | Plut | G06F 1/3218 345/211 |
| 2008/0192072 | A1* | 8/2008 | Park | G09G 3/3611 345/690 |
| 2012/0113379 | A1* | 5/2012 | Tomizawa | G09G 3/3607 349/187 |
| 2012/0327137 | A1* | 12/2012 | Saitoh | G09G 3/3648 345/690 |
| 2013/0236091 | A1* | 9/2013 | Ubillos | G06F 3/0482 382/163 |

FOREIGN PATENT DOCUMENTS

| | | | |
|---|---|---|---|
| JP | 2001236202 | A2 | 8/2001 |
| JP | 200760666 | A3 | 9/2008 |
| JP | 200915753 | A4 | 4/2009 |

* cited by examiner

| Index Range | Application Level |
|---|---|
| 0 ~ 0.2 | L1 |
| 0.2 ~ 0.8 | L2 |
| 0.8 ~ 1.0 | L3 |

FIG 5

DEVICE AND METHOD FOR REDUCING POWER CONSUMPTION IN DISPLAY DEVICES

PRIORITY

This application claims priority to Japanese Patent Application No. 2012-245756, filed 7 Nov. 2012, and all the benefits accruing therefrom under 35 U.S.C. §119, the contents of which in its entirety are herein incorporated by reference.

BACKGROUND

It is important to reduce the amount of power consumed by display devices, that is, provide display devices that save power. An example of one type of display device is liquid crystal display (LCD) devices. Until now, efforts have been made to improve LCDs themselves. For example, light-emitting diodes (LEDs) have been adopted in place of cold-cathode fluorescent lamps (CFLs), the power consumed by LCD backlighting devices has been reduced by adopting power-saving semiconductors in the circuitry, drive methods have been improved by dynamically changing backlighting when black is displayed, and materials have been improved, for example, by the development of liquid crystal elements that change at low voltage.

SUMMARY

Embodiments disclosed herein include a device for reducing power consumption in a display device. The device includes a recognizing unit for recognizing a display mode related to light and dark when no voltage is applied to the display device. The device also include a shift direction determining unit for determining a shift direction for the values of an image based on the display mode recognized by the recognizing unit so that power consumption is reduced in the display device. The device also includes a shift amount determining unit for determining a shift amount for the values of the image in accordance with a predetermined process. The device also includes a converting unit for converting the values of the image to be converted in the shift direction determined by the first determining unit in accordance with the shift amount determined by the second determining unit.

Further embodiments disclosed herein include a device for reducing power consumption in a display device that includes a determining unit for determining whether a display mode of the display device is a normally white mode or a normally black mode. This device also includes a shift direction determining unit for determining that a shift direction for the density of an image is in the direction of lower density in response to the determining unit determining the display mode is the normally white mode, and determining that the shift direction for the density of the image is in the direction of higher density in response to the determining unit determines the display mode is the normally black mode. This device also includes an acquiring unit for acquiring association information for associating a range of the density of the image with an allowable level related to change in appearance of the image based on a user operation that specifies the allowable level for each image density range. This device also includes a calculating unit for calculating the density of the image to be converted by determining the average values of an R value, G value and B value in the image to be converted. This device also includes a shift amount determining unit for determining a shift amount for the density of the image to be converted based on the allowable level associated by the association information with a range including the density of the image to be converted as calculated by the calculating unit.

This device also includes a converting unit for converting the density of the image to be converted in the shift direction determined by the shift direction determining unit by the shift amount determined by the shift amount determining unit and by changing the settings related to the colors in the cascading style sheet (CSS) used by the image to be converted.

Embodiments disclosed herein include a method for reducing power consumption in a display device. The method includes recognizing a display mode related to light and dark when no voltage is applied to the display device. The method also includes determining a shift direction for the values of an image based on the recognized display mode so that power consumption is reduced in the display device. The method further includes determining a shift amount for the values of the image in accordance with a predetermined process. The method further includes converting the values of the image to be converted in the determined shift direction in accordance with the determined shift amount.

BRIEF DESCRIPTION OF THE SEVERAL VIEWS OF THE DRAWINGS

FIG. 5 is a diagram showing an example of application level information generated in the embodiment of the present invention.

DETAILED DESCRIPTION

Figure 1:
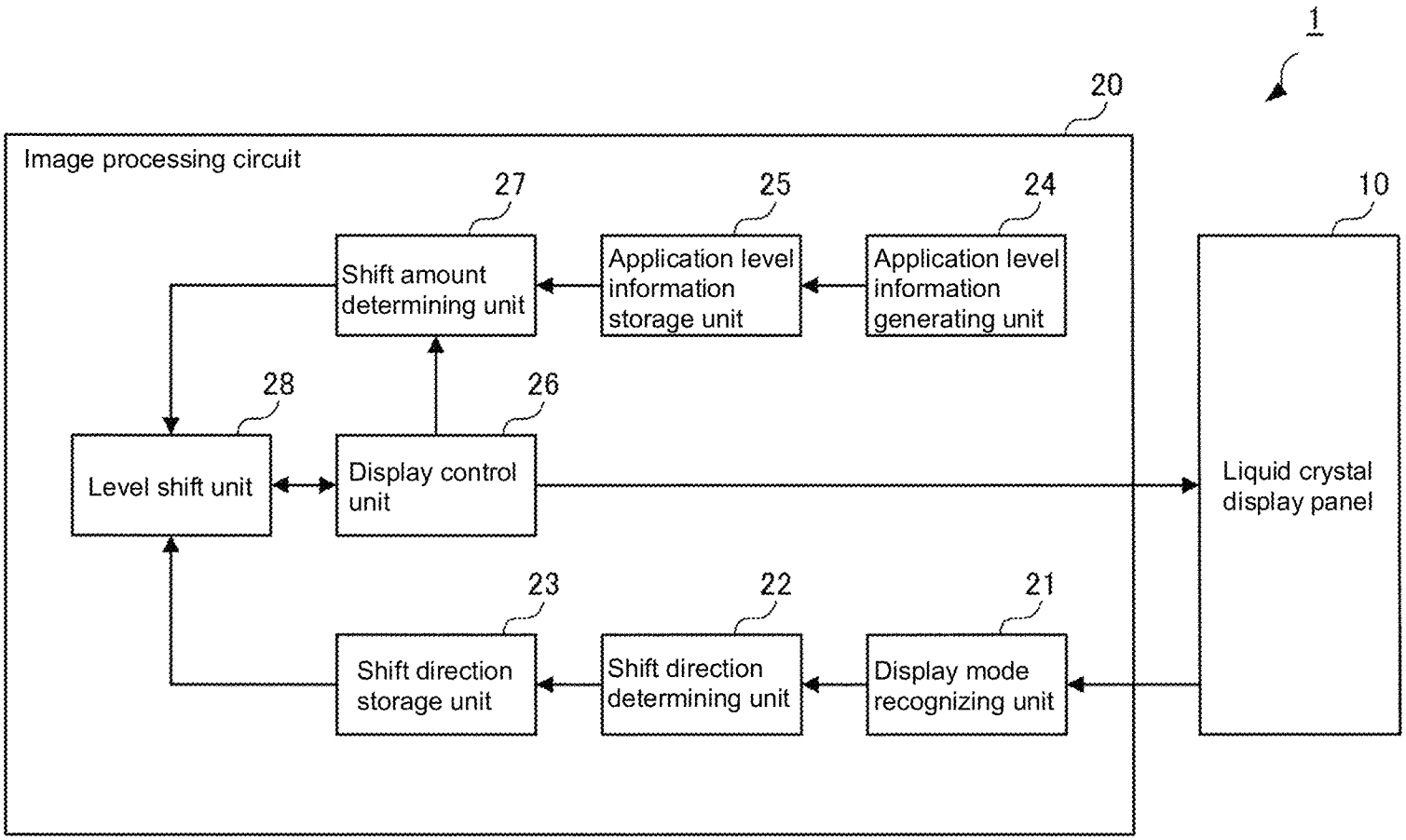
FIG. 1 is a block diagram showing the configuration of the liquid crystal display device in an embodiment of the present invention.

Embodiments disclosed herein relate to devices and methods for reducing power consumption in a display device.

Various conventional techniques reduce the power consumed by LCDs. One conventional technique involves a solar cell module that does not function as a power supply for charging a rechargeable battery when the output voltage value of the solar cells is less than 1V. Instead, the output voltage value is converted to a digital value by an A/D converter and read by a control unit, which outputs dimming control signals to change the brightness of a light source to 50 nits. When the output voltage value is from 1V to 3V, the rechargeable battery is charged, and the brightness of the light source is changed to 100 nits. When the output voltage value is greater than 3V, the rechargeable battery is charged, and the light source providing backlighting is turned OFF.

Another conventional technique processes images to be displayed so that the amount of power consumed by the display is reduced. A mobile communication terminal using this technique may execute the blocks of monitoring the process to determine whether or not the conditions for a power-saving mode have been met; measuring the color scheme of the image to be displayed on the screen when the conditions have been met and the power-saving mode has been deployed; and inverting the hues of the image when the results of the measurement indicate that predetermined hues exceed a predetermined ratio in the image.

Other conventional techniques change an image to be displayed. One such technique uses a cascading style sheet (CSS) and involves an operation unit for selecting and manipulating display functions; a storage unit for storing display data in response to more than one display function that can be selected and manipulated using the operation unit, and for storing shared style sheets for display layouts which were prepared beforehand; a screen generating unit for generating fixed HTML text using display data corresponding to the display functions selected and manipulated using the operation unit; a display control unit for generating HTML text adapted to the display size using the fixed HTML text corresponding to the display functions selected and manipulated using the operation unit using the shared style sheets; and a display unit for displaying images based on HTML text edited using the display control unit.

Another conventional technique changes an image to be displayed by having a user send a content transmission request to a server device from a client terminal, and the server device receives the request via a message transceiving unit and analyzes the content of the transmission request using a control unit. The control unit sends the desired content from a content storage unit to a content processing unit based on the results of analysis. The content processing unit receives the desired content, and processes the content based on instructions from the control unit to adapt the content to the screen display capacity of the client terminal. The processed content is then sent to the client terminal via the message transceiving unit.

Yet another conventional technique changes an image to be displayed by displaying a control screen when a 'display default page information' icon is clicked by a client, and the simple human interface on the control screen allows the client to make selections to display, instead of the default page information, change page layout information including an easy-to-read format, font size, and color scheme.

When an image is displayed on an LCD, the amount of power consumed depends on the content of the image. For example, an LCD in normally white mode consumes the most power not when white is displayed on the entire screen, but when black is displayed on the entire screen. However, an LCD in normally black mode consumes the most power when white is displayed on the entire screen. Thus, the amount of power consumed depends not only on the content to be displayed, but also on other characteristics such as the display mode of the LCD. However, some of the conventional techniques described above cannot reduce the amount of power consumed by existing LCDs. Furthermore, others of the conventional techniques described above can only be applied to an LCD with a specific display mode. Also, those of the techniques described above which change an image to be displayed do not reduce the amount of power consumed by an LCD.

Various embodiments disclosed herein reduce the amount of power consumed by an existing display device irrespective of the display mode. Various embodiments disclosed herein convert an image within the allowable range for a change in the appearance of the image so as to be able to reduce the amount of power consumed by an existing display device irrespective of the display mode.

Some embodiments disclosed herein produce these advantages by providing a device for reducing power consumption in a display device, which includes a recognizing unit for recognizing a display mode related to light and dark when no voltage is applied to the display device; a first determining unit for determining a shift direction for the values of an image based on the display mode recognized by the recognizing unit so that power consumption is reduced in the display device; a second determining unit for determining a shift amount for the values of an image in accordance with a predetermined process; and a converting unit for converting the values of the image to be converted in the shift direction determined by the first determining unit in accordance with the shift amount determined by the second determining unit.

Here, the first determining unit may determine the shift direction is in the direction in which the image becomes brighter when the recognizing unit recognizes a first mode in which the screen is light when no voltage is applied, and may determine the shift direction is in the direction in which the image becomes darker when the recognizing unit recognizes a second mode in which the screen is dark when no voltage is applied. Also, the converting unit may convert the values of the image to be converted by changing the settings of the cascading style sheet (CSS) used by the image to be converted. The second determining unit may determine the shift amount based on a user operation specifying the allowable level related to change in appearance of the image, or may determine the shift amount based on the values of the image to be converted. It may also determine the shift amount for each value of the image to be converted based on a user operation specifying the allowable level for each value of the image related to change in appearance of the image.

Various embodiments disclosed herein involve a device for reducing power consumption in a display device, which includes a judging unit for judging whether the display mode of the display device is normally white mode or normally black mode; a first determining unit for determining a shift direction for the density of an image is in the direction of lower density when the judging unit judges the display mode is normally white mode, and determining the shift direction for the density of the image is in the direction of higher density when the judging unit judges the display mode is normally black mode; an acquiring unit for acquiring association information for associating a range of the density of the image with an allowable level related to change in appearance of the image based on a user operation specifying the allowable level for each image density range; a calculating unit for calculating the density of the image to be converted by determining the average values of an R value, G value and B value in the image to be converted; a second determining unit for determining a shift amount for the density of the image to be converted based on the allowable level associated by the association information with a range including the density of the image to be converted as calculated by the calculating unit; and a converting unit for converting the density of the image to be converted in the shift direction determined by the first determining unit by the shift amount determined by the second determining unit by changing the settings related to the colors in the cascading style sheet (CSS) used by the image to be converted.

Various embodiments disclosed herein provide a method for reducing power consumption in a display device, which includes the blocks of recognizing a display mode related to light and dark when no voltage is applied to the display device; determining a shift direction for the values of an image based on the recognized display mode so that power consumption is reduced in the display device; determining a shift amount for the values of the image in accordance with a predetermined process; and converting the values of the image to be converted in the determined shift direction in accordance with the determined shift amount.

Some embodiments disclosed herein reduce the amount of power consumed by an existing display device irrespective of the display mode.

In some embodiments disclosed herein, the power consumed by the display device is reduced not by changing the meaning of the content to be displayed but by dynamically changing the density and colors of the content. In the following explanation, the display device is a liquid crystal display device. However, an embodiment disclosed herein can also be applied to other types of display devices, such as flat panel displays, active matrix displays, and electroluminescent (EL) displays.

The inventors of this application conducted a test to measure the effect of changing the density and colors of an image to be displayed on the amount of power consumed by a liquid crystal display device in normally white display mode. First, images filled in with grays of different densities were displayed on the liquid crystal display, and the amount of power consumed by the liquid crystal display was measured. The most power was consumed when the image was black, and less power was consumed as the shade of gray became lighter. Second, images in which a black area of varying sizes was arranged on a white background were displayed on a liquid crystal display device, and the amount of power consumed by the liquid crystal display was measured. Less power was consumed as the size of the black area became smaller. Third, images were created in which a color other than white was surrounded by a white area, and level shifts were performed on the color to obtain different contrasts with white. These images were displayed on a liquid crystal display, and the amount of power consumed by the liquid crystal display was measured. Less power was consumed as the contrast with white became smaller.

The inventors of this application also conducted a test to measure the effect of changing the style of actual image content on the amount of power consumed by a liquid crystal display device in normally white display mode. In this test, content was prepared in style A and style B. The content in style A was the original content. No changes were made to the content. The content in style B was content in which the colors of the original content were level-shifted towards white. More specifically, a level shift greater than 50% was performed on the R values, G values, and B values. Less power was consumed when the content in style B was displayed, than when the content in style A was displayed.

Because drive power is used to generate the light itself in organic EL display devices, the effects are expected to be greater. Also, the amount of drive power used increases as the screen size and number of pixels increases. In this case, an even greater effect can be expected.

The following is a more detailed explanation of an embodiment of the present invention with reference to the appended drawings. FIG. 1 is a block diagram showing the configuration of the liquid crystal display device 1 in an embodiment of the present invention. As shown in the drawing, the liquid crystal display device 1 includes a liquid crystal display panel 10 and an image processing circuit 20.

The liquid crystal display panel 10 is composed of a liquid crystal layer interposed between glass substrates, and the amount of light emitted from behind by a backlight (not shown) is controlled by applying voltage to the liquid crystal layer to display an image. Here, the liquid crystal display panel 10 has a display mode. There are two display modes; one is a normally white mode (NW mode) in which the display is light (white) when no voltage is applied, and the other is a normally black mode (NB mode) in which the display is dark (black) when no voltage is applied. For example, a liquid crystal display panel 10 using a twisted nematic (TN) drive method usually has a NW mode, and a liquid crystal display panel 10 using an in-plane switching (IPS) drive method usually has a NB mode. Because a liquid crystal display panel 10 is detachably mounted in a liquid crystal display device 1, the display mode of the liquid crystal display panel 10 determines the display mode of the liquid crystal display device 1 in which it is mounted.

The image processing circuit 20 processes images in accordance with the display mode of the liquid crystal display panel 10 in order to reduce the amount of power consumed by the liquid crystal display device 1 with respect to the image to be displayed. More specifically, the image processing circuit 20 includes a display mode recognizing unit 21, a shift direction determining unit 22, and a shift direction storage unit 23. It also includes an application level information generating unit 24, and an application level information storage unit 25. In addition, it includes a display control unit 26, a shift amount determining unit 27, and a level shifting unit 28.

The display mode recognizing unit 21 recognizes the display mode of the liquid crystal display panel 10. More specifically, it judges whether the display mode is the NW mode or the NB mode. Here, the display mode may be recognized by exchanging information with the liquid crystal display panel 10 on the extended display identification data (EDID) format as defined by the Video Electronics Standards Association (VESA). The display mode recognizing unit 21 is provided in an embodiment disclosed herein as an example of a recognizing unit used to recognize the display mode or a judging unit for judging whether or not the display mode is the NW mode or the NB mode.

The shift direction determining unit 22 determines the direction of the level shift for the values of the image (for example, density and color values) in accordance with the display mode recognized by the display mode recognizing unit 21 so that the amount of power consumed by the liquid crystal display device 1 can be reduced. For example, when the display mode recognized by the display mode recognizing unit 21 is the NW mode, the unit determines that the shift direction for the values of the image is towards a brighter (white) display, and when the display mode recognized by the display mode recognizing unit 21 is the NB mode, the unit determines that the shift direction for the values of the image is towards a darker (black) display. The shift direction determining unit 22 is provided in an embodiment disclosed herein as an example of a first determining unit for determining the shift direction for the values of the image.

The shift direction storage unit 23 stores the shift direction determined by the shift direction determining unit 22.

The application level information generating unit 24 generates application level information which associates an image value range with an application level. Any reduction in power consumption is undesirable if it leads to deterioration in image appearance. Therefore, the application level information generating unit 24 is used to set the application level, which indicates the amount of level shift allowed before the deterioration in image appearance becomes unacceptable to the user. Even when a certain level shift has been performed, the degree of deterioration in image appearance depends on the values of the image. Therefore, the application level information generating unit 24 divides image values into a plurality of ranges, allowing the user to set the application level for each range. The application level may be set for each image value, but here it is set for each range of image values. The application level may be an abstract concept such as 'image quality preferred', 'power saving preferred', or large/middle/small. It may also be the specific amount of the level shift to be applied. Also, the application level may be set on a setting screen. This is explained in greater detail below. The application level information generating unit 24 generates application level information based on the settings selected by the user. The application level information generating unit 24 is provided in the present invention as an example of an acquiring unit for acquiring association information, and the application level information is an example of association information which associates ranges with allowable levels.

The application level information storage unit 25 stores the application level information generated by the application level information generating unit 24.

The display control unit 26 performs display controls such as those for updating the screen displayed on the liquid crystal display panel 10. More specifically, the image to be converted is cut out of the original image to be displayed on the screen (that is, it may be a portion of the image or the entire image), and the average grayscale value of the image to be converted is calculated. Afterwards, the amount of level shift is determined by the shift amount determining unit 27 using the average grayscale value, the image to be converted is level-shifted by the level shifting unit 28, and the display screen is updated with the level-shifted image. Here, the average grayscale value is obtained by taking the sum of R values, G values and B values of all pixels in the image to be converted and dividing it by (total number of pixels×3×maximum possible pixel value). The largest value is "1", and the smallest value is "0". For example, when there are 2×2 pixels in the image to be converted, the R value, G value and B value of all of the pixels are 12, 32, and 64, respectively, and the maximum values for the R value, G value and B value are all 255, the average grayscale value is 0.14 (=(12+32+64)×4/(4×3×255)). In the present description, the average grayscale value is called the "index". In an embodiment disclosed herein, the display control unit 26 is provided as an example of a calculating unit for calculating the density of the image to be converted, and the index is used as an example of the density of the image to be converted.

The shift amount determining unit 27 determines the amount of level shift ("shift amount") for the values of the image (for example, density and color) based on the application level information stored in the application level information storage unit 25 and the index provided by the display control unit 26. More specifically, a range is selected which includes the index provided by the display control unit 26 from among the image value ranges included in the application level information stored in the application level information storage unit 25, an application level associated with this range in the application level information is specified, and a shift amount is determined in accordance with the specified application level. If the application level is an abstract concept, the abstract concept is converted to a shift amount. On the other hand, if the shift amount itself is used as the application level, the application level is used as the shift amount. In an embodiment disclosed herein, the shift amount determining unit 27 is provided as an example of a second determining unit for determining the shift amount for the image values.

The level shifting unit 28 performs a level shift on the settings (for example, color settings) of the cascade style sheet (CSS) used by the image to be converted which was provided by the display control unit 26. When a document is displayed on a web browser, the structure and appearance of the document are separately handled. The CSS defines the appearance of the document. This way, even when the same document is displayed, the size of the text and the background color can be easily changed based on intended use or preference. In an embodiment disclosed herein, the level shifting unit 28 is provided as an example of a converting unit for converting the values of the image to be converted.

Here, 'level shift' refers to an image processing technique in which the values of each pixel in an entire image to be converted are shifted in the black direction or white direction, and a maximum value or minimum value is applied to a saturated pixel. There are two level shift methods. In the first method, a shift is performed using a predetermined amount. In the second method, the shift is performed using a function which takes distribution into account. A level shift can be performed on the sub-pixel level. More specifically, a level shift is performed according to the following equation. Here, the maximum value for sub-pixel values is MaxV, the minimum value is 0, the sub-pixel value before conversion is V, and the sub-pixel value after conversion is cV.

When the level shift is performed using the first method, the shift amount S is determined in the white direction using Equation (1), and in the black direction using Equation (2).

$$cV=[V+S] \tag{1}$$

$$cV=[V-S] \tag{2}$$

Here, the brackets [ ] indicate an operation performed to apply the maximum value when the calculation produces a value greater than the maximum value, and to apply the minimum value when the calculation produces a value smaller than the minimum value.

When the level shift is performed using the second method, the shift amount S is determined in the white direction using Equation (3), and in the black direction using Equation (4).

$$cV = S + \frac{\mathrm{Max}V - S}{\mathrm{Max}V} \times V \tag{3}$$

$$cV = \frac{\mathrm{Max}V - S}{\mathrm{Max}V} \times V \tag{4}$$

Figure 2:
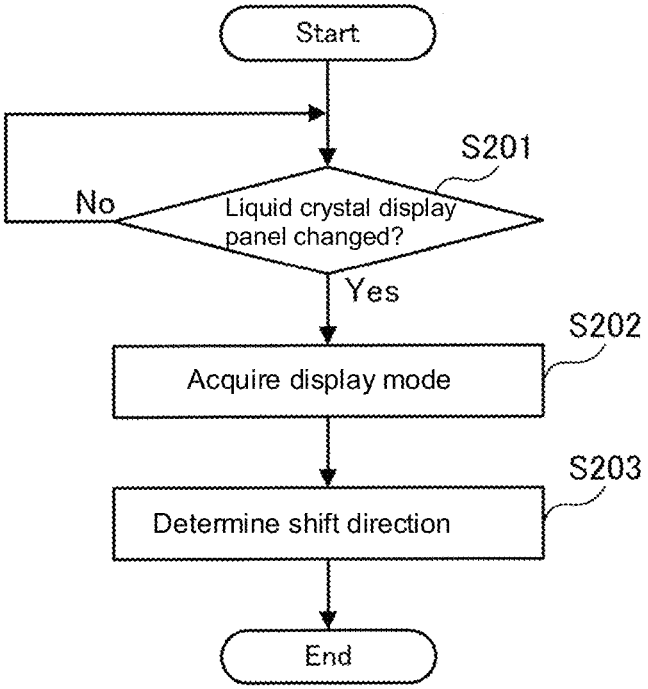
FIG. 2 is a flowchart showing the operations performed by the display mode recognizing unit and the shift direction determining unit in the embodiment of the present invention.

The following is an explanation of the operations performed by the image processing circuit 20 in an embodiment disclosed herein. First, the operations performed by the image processing circuit 20 to obtain the display mode of the liquid crystal display panel 10 will be explained. FIG. 2 is a flowchart showing an example of the operations of the display mode recognizing unit 21 and the shift direction determining unit 22 performed at this time. As shown in the drawing, the display mode recognizing unit 21 first determines whether the liquid crystal display panel 10 has been changed (Block 201). If the liquid crystal display panel 10 has not been changed, Block 201 is repeated. If the liquid crystal display panel 10 has been changed, the display mode recognizing unit 21 acquires the display mode of the liquid crystal display panel 10 (Block 202). Next, the shift direction determining unit 22 determines the shift direction for the image values based on the display mode acquired in Block 202 (Block 203). More specifically, it determines the shift direction in the white direction if the display mode is the NW mode, and determines the shift direction in the black direction if the display mode is the NB mode. The shift direction determined here is stored in the shift direction storage unit 23. This may be stored as binary data, for example, "1" for the white direction and "0" for the black direction.

Figure 3:
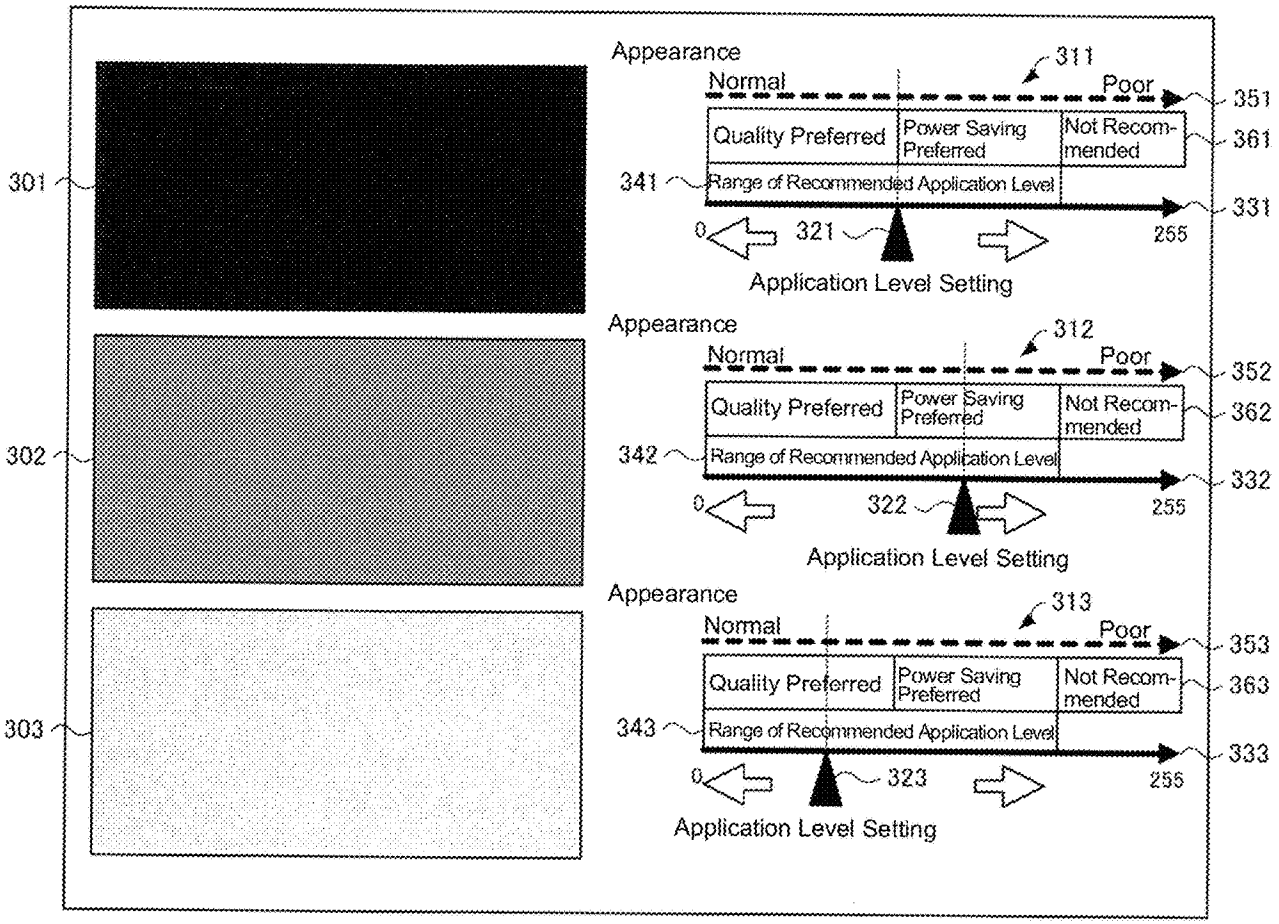
FIG. 3 is a diagram showing an example of the setting screen displayed when application level information is generated in the embodiment of the present invention.

Next, the operations performed by the image processing circuit 20 to generate application level information will be explained. FIG. 3 is a diagram showing an example of the setting screen displayed on the liquid crystal display panel 10 when the application level information generating unit 24 generates application level information. As shown in the drawing, the setting screen simultaneously displays three different pattern images. Among the three pattern images, pattern image 301 is a dark image, pattern image 302 is a normal image, and pattern image 303 is a light image. More specifically, pattern image 301 is an image corresponding to index range 0-0.2 in which the typical value within the index range is 0.1, pattern image 302 is an image corresponding to index range 0.2-0.8 in which the typical value within the index range is 0.5, and pattern image 303 is an image corresponding to index range 0.8-1.0 in which the typical value within the index range is 0.9.

On this setting screen, three control panels are also displayed along with the images. These control panels are used to set the application level. These three control panels include a control panel 311, which is used to set the application level for the dark image in pattern image 301, a control panel 312, which is used to set the application level for the normal image in pattern image 302, and a control panel 313, which is used to set the application level for the dark image in pattern image 303.

The following is a more detailed explanation of the control panel 311. This control panel 311 includes a slider bar 321 which the user can slide in a horizontal direction to change and set the application level. It also includes a scale indicator 331 for indicating the index corresponding to the application level set using the slider bar 321, and a recommended range indicator 341 indicating the range recommended for the index displayed by the scale indicator 331. It also includes a scale indicator 351 indicating the image appearance corresponding to the application level set using the slider bar 321, and a preference indicator 361 indicating quality or power saving is preferred, or not recommended, for the appearance of the image indicated by the scale indicator 351. The other control panels 312, 313 include the same indicators. The setting screen shifts the level and displays the corresponding pattern images 301, 302, 303 when the application level is changed using the control panels 311, 312, 313.

The setting screen in FIG. 3 may be displayed on a display device other than the liquid crystal display panel 10 that is the target of power savings. In this explanation, however, it is displayed on the liquid crystal display panel 10 that is the target of power savings.

Figure 4:
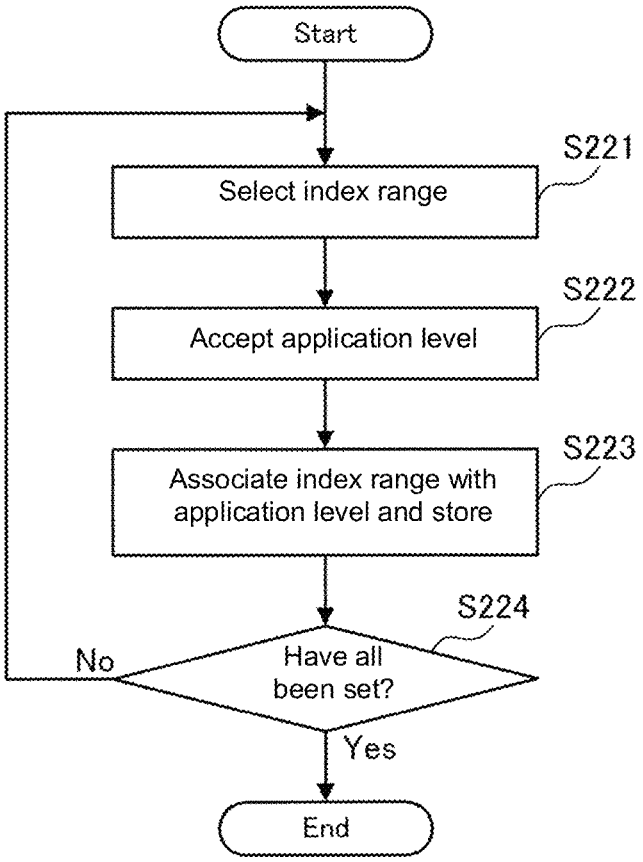
FIG. 4 is a flowchart showing the operations performed by the application level information generating unit in the embodiment of the present invention.

FIG. 4 is a flowchart showing an example of the operations performed by the application level information generating unit 24 at this time. It is assumed that the setting screen in FIG. 3 is displayed on the liquid crystal display panel 10 prior to these operations. As shown in the drawing, the application level information generating unit 24 first selects an index range (Block 221). More specifically, the application level information generating unit 24 selects, for example, index range 0-0.2 from among index ranges 0-0.2, 0.2-0.8 and 0.8-1.0. Next, the application level information generating unit 24 accepts the application level selected by the user with respect to the index range selected in Block 221 (Block 222). More specifically, in the setting screen on FIG. 3, user operations on the control panel corresponding to the index range selected in Block 221 are enabled, and a level-shifted pattern image is displayed in accordance with the application level set by the user on the control panel. For example, when index range 0-0.2 is selected in Block 221, pattern image 301 is level-shifted and displayed based on the user operations on the control panel 311. When the user confirms the setting for the application level, the application level is accepted. The application level information generating unit 24 then associates the index range selected in Block 221 with the application level accepted in Block 222, and stores the associated index range and application level in the application level information storage unit 25 (Block 223). Next, the application level information generating unit 24 determines whether or not application levels have been recorded for all of the index ranges (Block 224). If application levels have not been recorded for all of the index ranges, the same process is performed on the next index range. When application levels have been recorded for all of the index ranges, the process is ended.

FIG. 5 shows an example of application level information stored in the application level information storage unit 25 when the operations in FIG. 4 have been completed. As shown in the drawing, the application level information associates an index range with an application level. The indicated index ranges are 0-0.2, 0.2-0.8 and 0.8-1.0, which coincide with the example of the setting screen in FIG. 3. The application levels are recorded as L1, L2 and L3, which may represent the shift amounts themselves, or may represent concepts such as "large", "middle" and "small". When concepts such as "large", "middle" and "small" are used, the shift amount for a "large" application level, the shift amount for a "middle" application level, and the shift amount for a "small" application level may be managed separately.

Figure 6:
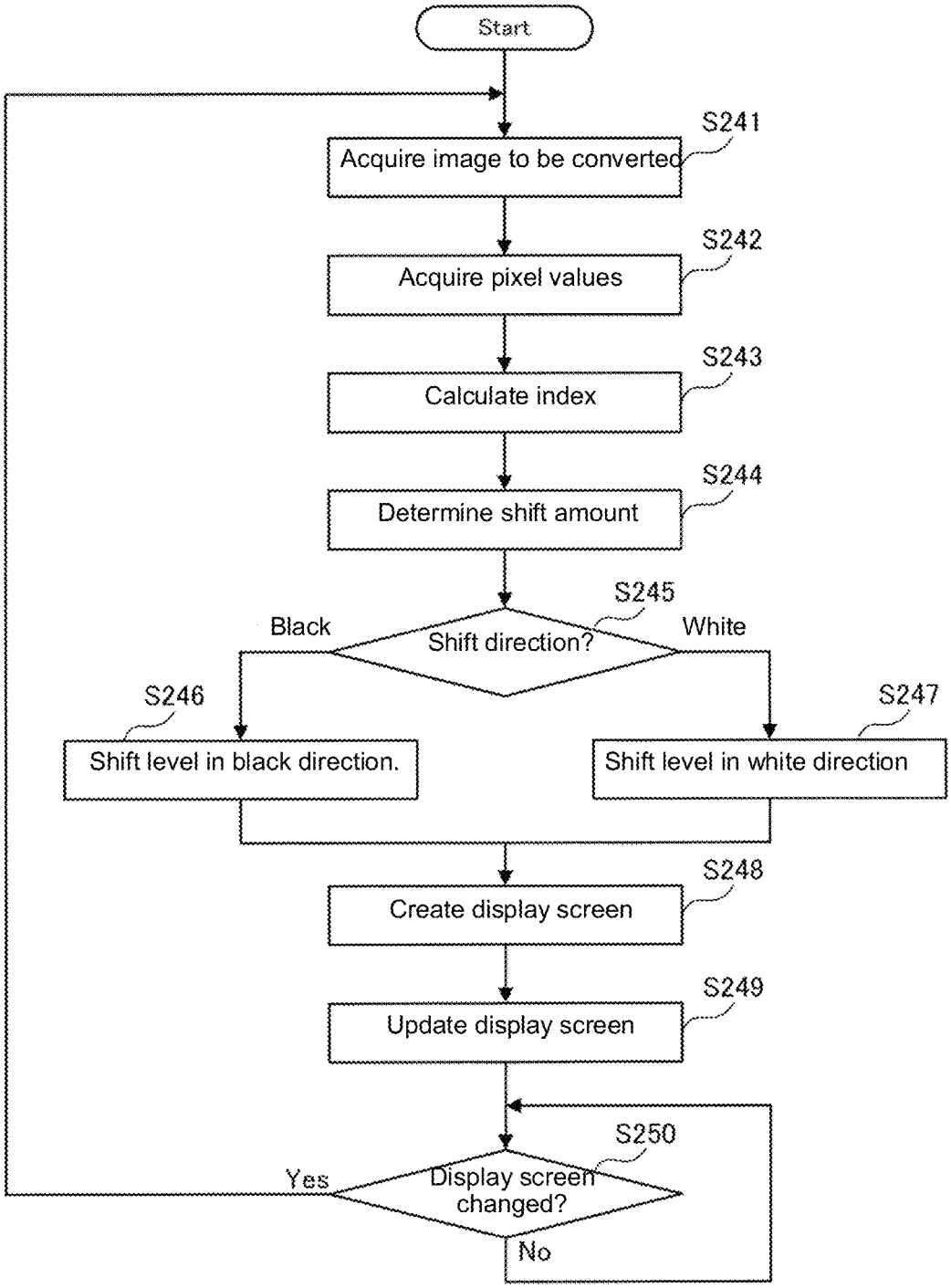
FIG. 6 is a flowchart showing the operations performed by the display control unit, the shift amount determining unit, and the level shifting unit in the embodiment of the present invention.

The following is an explanation of the operations performed by the image processing circuit 20 to update the screen displayed on the liquid crystal display panel 10. FIG. 6 is a flowchart showing an example of the operations performed by the display control unit 26, the shift amount determining unit 27, and the level shifting unit 28 at this time. It is assumed that the screen based on the image to be displayed is displayed on the liquid crystal display panel 10 prior to these operations. As shown in the drawing, the display control unit 26 first acquires an image to be converted from the image to be displayed (Block 241). Here, the image to be converted may be the entire image to be displayed or a portion of the image to be displayed. A portion of the image to be displayed may be the area of the image corresponding to the window displayed by the application selected by the user, or the area of the image in which a specific CSS is valid when the original data of the image to be displayed is written in HyperText Markup Language (HTML) using CSS. The image to be converted is sent to the level shifting unit 28.

Next, the display control unit 26 acquires the values for all of the pixels in the image to be converted acquired in Block 241 (Block 242), and the index is calculated (Block 243). More specifically, in Block 242, the R values, G values and B values of all of the pixels are acquired. In Block 243, the index is calculated by taking the sum of R values, G values and B values of all of the pixels and dividing it by (total number of pixels×3×maximum possible pixel value). The index is sent to the shift amount determining unit 27.

The shift amount determining unit 27 determines the shift amount based on the index provided by the display control unit 26 and the application level information stored in the application level information storage unit 25 (Block 244). More specifically, the index range including the index provided by the display control unit 26 is selected from the application level information, and the shift amount is determined based on the application level associated with the selected index range. Here, if the application level indicates the shift amount itself, the shift amount determined in Block 244 may be the one indicated by the application level. If the application level indicates concepts such as "large", "middle" or "small", the shift amount may be determined by referencing information associating these concepts with shift amounts.

Next, the level shifting unit 28 determines whether the shift direction stored in the shift direction storage unit 23 is in the black direction or in the white direction (Block 245). If the shift direction is in the black direction, the level shifting unit 28 shifts the image to be converted provided from the display control unit 26 in the black direction by the shift amount determined in Block 244 (Block 246). If the shift direction is in the white direction, the level shifting unit 28 shifts the image to be converted provided from the display control unit 26 in the white direction by the shift amount determined in Block 244 (Block 247). If the image to be converted was acquired as the area of an image in which a specific CSS is valid, the level shift may be performed by changing the CSS settings (for example, color settings). Here, the R values, G values and B values of the pixels are all level-shifted by the same shift amount. Alternatively, color shift (color temperature conversion) may be performed in which the R values, G values and B values of the pixels are level-shifted by different shift amounts. The level-shifted image is returned to the display control unit 26.

Then, the display control unit 26 replaces the image to be converted included in the image to be displayed with the level-shifted image to create a new image to be displayed, and creates a new display screen based on this image (Block 248). Next, the display control unit 26 updates the screen displayed on the liquid crystal display panel 10 with the new display screen (Block 249). Afterwards, the display control unit 26 judges whether or not the display screen has been changed (Block 250). If it judges that the display screen has not been changed, it continues the monitoring process to judge whether or not the display screen has been changed. If it judges that the display screen has been changed, it performs the same process on the image after the change. This ends the explanation of the operations performed in an embodiment disclosed herein.

In an embodiment disclosed herein, the level shift was performed all at once on all of the pixels in the image to be converted. However, the present invention is not limited to this. For example, the level shift may be performed on all of the pixels in the image to be converted one pixel at a time. In that case, Blocks 242-247 in FIG. 6 may be executed for each pixel. More specifically, in Block 243, the index may be calculated from the R value, G value and B value of one pixel in the image to be converted, rather than by taking the sum of the R values, G values and B values of all of the pixels in the image to be converted.

In an embodiment disclosed herein, the application level information generating unit 24 generates application level information based on a user operation, and the shift amount determining unit 27 determines the shift amount using this application level information. However, the present invention is not limited to this. The shift amount determining unit 27 may determine the shift amount using a predetermined process. For example, shift amount determining unit 27 may determine the shift amount automatically irrespective of user operations. The method used to automatically determine the shift amount may be any type of definition information used to determine the shift amount based on image values. For example, the method may use a shift amount conversion function. This shift amount conversion function is defined by Equation (5), where the shift amount is s and the index is ix.

$$S=f(ix) \tag{5}$$

Here, the function f may be determined using input values and a brightness curve of the liquid crystal display device 1.

Figure 7:
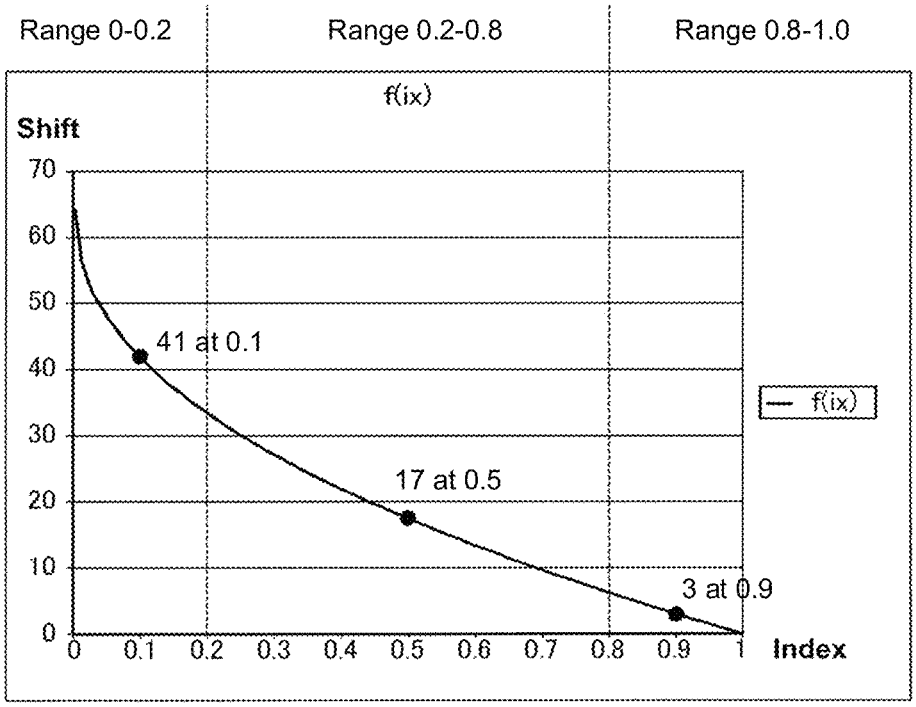
FIG. 7 is a graph showing the function used when the shift amount is determined automatically in the embodiment of the present invention.

An example of the shift amount conversion function f is shown in FIG. 7. In this drawing, the indexes are divided into three ranges. The first range is for indexes from 0 to 0.2, and an index representing this range is 0.1. The shift amount s for this index is 41. The second range is for indexes from 0.2 to 0.8, and an index representing this range is 0.5. The shift amount s for this index is 17. The third range is for indexes from 0.8 to 1.0, and an index representing this range is 0.9. The shift amount s for this index is 3.

Some embodiments disclosed herein reduce the amount of power consumed by a single liquid crystal display device 1. However, the techniques disclosed herein may also be used to reduce the amount of power consumed by multiple displays. In this case, the setting screen in FIG. 3 is used to set the application level for each of the displays.

In an embodiment disclosed herein, as described above, the image to be displayed is level-shifted in the white direction when the display mode of the liquid crystal display panel 10 is the NW mode, and the image to be displayed is level-shifted in the black direction when the display mode of the liquid crystal display panel 10 is the NB mode. In this way, the amount of power consumed by an existing LCD can be reduced irrespective of the display mode. In an embodiment disclosed herein, the shift amount caused by the level shift is set by the user after verifying the change in the appearance of the image on the setting screen in FIG. 3. In this way, the amount of power consumed by an existing LCD can be reduced irrespective of the display mode, and image conversion is performed within an allowable range in terms of the change in image appearance.

In an embodiment disclosed herein, the conversion of images to reduce the amount of power consumed by the liquid crystal display device 1 was performed by the image processing circuit 20 mounted in the liquid crystal display device 1. However, the present invention is not limited to this. For example, the image conversion may be performed by a separate device connected to the liquid crystal display device 1. Here, the separate device may be another computer such as a personal computer (PC) connected to the liquid crystal display device 1 via a universal serial bus (USB), or a server computer connected via the internet to a PC with a liquid crystal display device 1.

Figure 8:
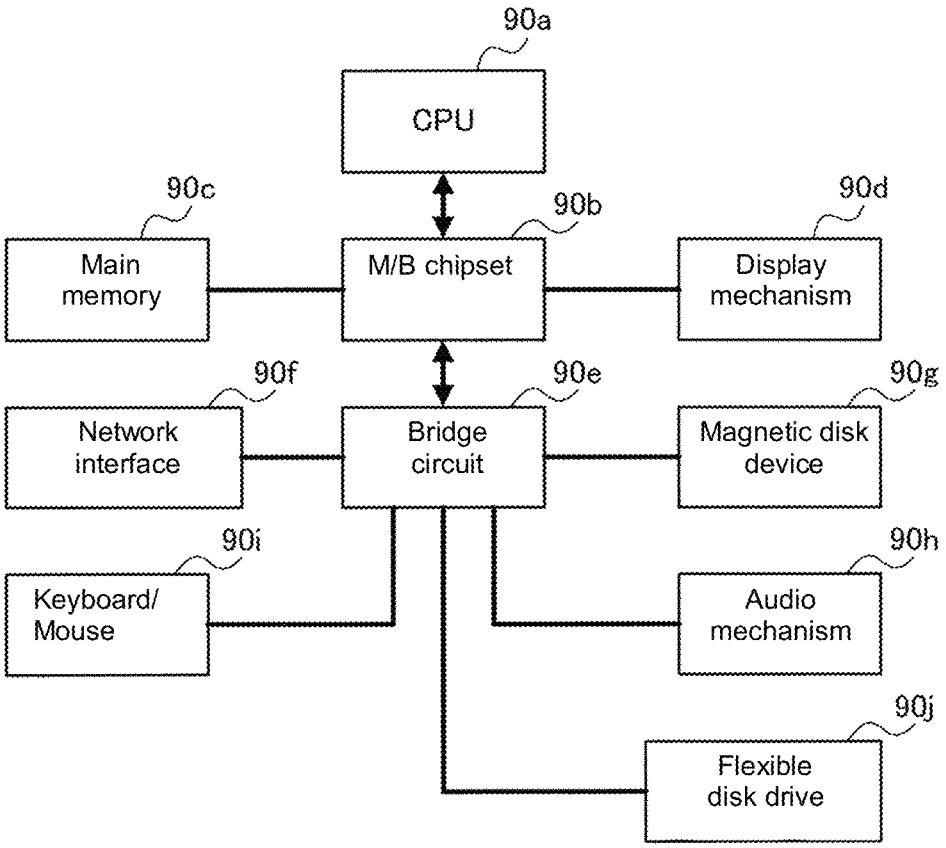
FIG. 8 is a diagram showing the hardware configuration of a computer able to realize the embodiment of the present invention.

Finally, a hardware configuration of a computer such as PC or server computer that can be used to implement the embodiments described herein will be explained. FIG. 8 is a diagram showing an example of such a computer hardware configuration. As shown in the drawing, the computer includes a central processing unit (CPU) 90*a* serving as a computing means, a main memory 90*c* connected to the CPU 90*a* via a motherboard (M/B) chip set 90*b*, and a display mechanism 90*d* connected to the CPU 90*a* via the same M/B chip set 90*b*. A network interface 90*f*, magnetic disk device (HDD) 90*g*, audio mechanism 90*h*, keyboard/mouse 90*i*, and flexible disk drive 90*j* are also connected to the M/B chip set 90*b* via a bridge circuit 90*e*.

In FIG. 8, each element is connected via a bus. For example, the CPU 90*a* and the M/B chip set 90*b*, and the M/B chip set 90*b* and the main memory 90*c* are connected via a CPU bus. Also, the M/B chip set 90*b* and the display mechanism 90*d* may be connected via an accelerated graphics port (AGP). However, when the display mechanism 90*d* includes a PCI express-compatible video card, the M/B chip set 90*b* and the video card are connected via a PCI express (PCIe) bus. Also, PCI Express may be used as the network interface 90*f* if, for example, it is connected to the bridge circuit 90*e*. For the magnetic disk devices 90*g*, *a* serial AT attachment (ATA), a parallel-transmission ATA, and peripheral components interconnect (PCI) or the like may be used. The keyboard/mouse 90*i* and the flexible disk drive 90*j* may use a universal serial bus (USB).

Embodiments disclosed herein may be realized by hardware or software in its entirety. Such embodiments may also be realized by a combination of both hardware and software. Furthermore, embodiments disclosed herein may be realized as a computer, data processing system, or computer program. The computer program may be stored on a computer-readable medium and distributed. Here, the medium may be electronic, magnetic, optical, mechanical, infrared, or a semiconductor system (device or equipment). It may also be a propagation medium. Examples of computer-readable media include semiconductor, solid-state storage device, magnetic tape, removable computer diskette, random-access memory (RAM), read-only memory (ROM), rigid magnetic disk, and optical disk. Examples of optical disks at the present time include compact disk read-only memory (CD-ROM), compact disk read/write (CD-R/W), and DVD.

While the disclosure above explains with reference to particular embodiments, the technical scope of embodiments of the present invention is not limited in any way by these particular embodiments. It should be clear to a person of skill in the art that various modifications and substitutions can be made without departing from the spirit and scope of the present invention.

The invention claimed is:

1. A power consumption reducing device of a display device, the device comprising:

a recognizing unit configured to recognize a display mode related to light and dark when no voltage is applied to the display device;

a shift direction determining unit configured to determine a shift direction for the values of an image based on the display mode recognized by the recognizing unit so that power consumption is reduced in the display device;

a shift amount determining unit configured to determine a shift amount for the values of the image based on a first user operation that specifies an allowable level for each value of the image related to change in appearance of the image and based on the values of the image to be converted, wherein a shift S is determined in a white direction using a first calculation of cV=? [V+S], and in a black direction using a second calculation of cV=? [V−S], wherein the shift S is the shift amount, V is a sub-pixel value before a conversion, and cV is a sub-pixel value after the conversion, wherein the shift S applies a maximum value when one or both of the first and second calculations produce a value greater than the maximum value and applies a minimum value when one or both of the first and second calculations produce a value smaller than the minimum value; and a converting unit configured to convert the values of the image to be converted in the shift direction determined by the first determining unit in accordance with the shift amount determined by the second determining unit and changing the settings of the cascading style sheet (CSS) used by the image to be converted; and an acquiring unit configured to acquire association information for associating a range of a density of the image with the allowable level related to change in appearance of the image based on a second user operation that specifies an allowable level for each image density range.

2. The device of claim 1, wherein the shift direction determining unit determines that the shift direction is in the direction in which the image becomes brighter in response to the recognizing unit recognizing a first mode in which the screen is light when no voltage is applied, and determines that the shift direction is in the direction in which the image becomes darker in response to the recognizing unit recognizing a second mode in which the screen is dark when no voltage is applied.

3. A device for reducing power consumption in a display device, the device comprising:

a recognizing unit configured to determine whether a display mode of the display device is a normally white mode or a normally black mode;

a shift direction determining unit configured to determine:

that a shift direction for the density of an image is in the direction of lower density in response to the determination by the determining unit that the display mode is the normally white mode, and that the shift direction for the density of the image is in the direction of higher density in response to the determination by the determining unit that the display mode is the normally black mode;

an acquiring unit configured to acquire association information for associating a range of the density of the image with an allowable level related to change in appearance of the image based on a user operation that specifies the allowable level for each image density range;

a calculating unit configured to calculate the density of the image to be converted by determining the average values of an R value, G value and B value in the image to be converted;

a shift amount determining unit configured to determine a shift amount for the density of the image to be converted based on the allowable level associated by the association information with a range including the density of the image to be converted as calculated by the calculating unit and based on the values of the image to be converted, wherein a shift S is determined in a white direction using a first calculation of cV=[illegible] [V+S], and in a black direction using a second calculation of cV=[illegible] [V−S], wherein the shift S is the shift amount, V is a sub-pixel value before a conversion, and cV is a sub-pixel value after the conversion, wherein the shift S applies a maximum value when one or both of the first and second calculations produce a value greater than the maximum value and applies a minimum value when one or both of the first and second calculations produce a value smaller than the minimum value; and a converting unit configured to convert the density of the image to be converted in the shift direction determined by the shift direction determining unit by the shift amount determined by the shift amount determining unit and by changing the settings related to the colors in the cascading style sheet (CSS) used by the image to be converted.

4. The device of claim 3, wherein the shift direction determining unit determines that the shift direction is in the direction in which the image becomes brighter in response to the recognizing unit recognizing a first mode in which the screen is light when no voltage is applied, and determines that the shift direction is in the direction in which the image becomes darker in response to the recognizing unit recognizing a second mode in which the screen is dark when no voltage is applied.

5. A method for reducing power consumption in a display device, the method comprising:

recognizing a display mode related to light and dark when no voltage is applied to the display device;

determining a shift direction for the values of an image based on the recognized display mode so that power consumption is reduced in the display device;

determining a shift amount for the values of the image in accordance with a predetermined process based on a user operation that specifies an allowable level for each value of the image related to change in appearance of the image and based on the values of the image to be converted, wherein a shift S is determined in a white direction using a first calculation of cV=[illegible] [V+S], and in a black direction using a second calculation of cV=[illegible] [V−S], wherein the shift S is the shift amount, V is a sub-pixel value before a conversion, and cV is a sub-pixel value after the conversion, wherein the shift S applies a maximum value when one or both of the first and second calculations produce a value greater than the maximum value and applies a minimum value when one or both of the first and second calculations produce a value smaller than the minimum value;

converting the values of the image to be converted in the determined shift direction in accordance with the determined shift amount; and acquiring association information for associating a range of a density of the image with the allowable level related to change in appearance of the image based on a user operation that specifies the allowable level for each image density range.

6. The method of claim 5, wherein the determining that the shift direction is in the direction in which the image becomes brighter is in response to recognizing a first mode in which the screen is light when no voltage is applied, and the determining that the shift direction is in the direction in which the image becomes darker in response to a second mode in which the screen is dark when no voltage is applied.

* * * * *